US010773419B2

(12) United States Patent
Rosello Gargallo

(10) Patent No.: US 10,773,419 B2
(45) Date of Patent: Sep. 15, 2020

(54) CUTTING AND SEPARATING DEVICE APPLICABLE TO MANUAL CERAMIC CUTTERS

(71) Applicant: GERMANS BOADA, S.A., Rubi, Barcelona (ES)

(72) Inventor: Alex Rosello Gargallo, Barcelona (ES)

(73) Assignee: GERMANS BOADA, S.A., Barcelona (ES)

( * ) Notice: Subject to any disclaimer, the term of this patent is extended or adjusted under 35 U.S.C. 154(b) by 350 days.

(21) Appl. No.: 15/763,786

(22) PCT Filed: Jul. 19, 2016

(86) PCT No.: PCT/ES2016/070543

§ 371 (c)(1),
(2) Date: Mar. 27, 2018

(87) PCT Pub. No.: WO2017/055650

PCT Pub. Date: Apr. 6, 2017

(65) Prior Publication Data

US 2018/0290335 A1 Oct. 11, 2018

(30) Foreign Application Priority Data

Sep. 28, 2015 (ES) ..... 201531375

(51) Int. Cl.
*B28D 1/22* (2006.01)

(52) U.S. Cl.
CPC ..... *B28D 1/228* (2013.01); *B28D 1/225* (2013.01)

(58) Field of Classification Search
CPC ..... B28D 1/228; B28D 1/225; C03B 33/033
(Continued)

(56) References Cited

U.S. PATENT DOCUMENTS 2,372,784 A * 4/1945 Jansen ..... B26D 1/305 83/562
2,395,978 A * 3/1946 Swenson ..... B28D 1/223 125/23.01

(Continued)

FOREIGN PATENT DOCUMENTS

EP 0 501 053 A1 9/1992
ES 295592 U 4/1987

(Continued)

OTHER PUBLICATIONS

International Search Report of related International Patent Application No. PCT/ES2016/070543 dated Nov. 11, 2016.

(Continued)

*Primary Examiner* — George B Nguyen
(74) *Attorney, Agent, or Firm* — Arent Fox LLP

(57) ABSTRACT

The invention relates to a cutting and separating device applicable to manual ceramic cutters, comprising: a carriage; a collapsible handle with a cutting tool; a toothed part comprising a separator for separating ceramic parts; springs for holding the toothed part in an inoperative position as well as a toothed actuator in an engaged position with the toothed part; and a manual trigger element for disengaging the toothed actuator. The rotation of the handle past a predetermined angle causes the engagement of the toothed actuator in the toothed part; the descending rotation causes the toothed actuator to rotate the toothed part until an operative position of the separator is reached; and the actuation of the trigger element causes the release of the toothed part and the return thereof to the inoperative position.

5 Claims, 5 Drawing Sheets

(58) Field of Classification Search
USPC ..... 125/23.01
See application file for complete search history.

(56) References Cited

U.S. PATENT DOCUMENTS

| | | | | |
|---|---|---|---|---|
| 5,480,081 | A | 1/1996 | Wilson et al. | |
| 6,047,871 | A * | 4/2000 | Chen | B28D 1/225 125/23.02 |
| 6,053,159 | A * | 4/2000 | Liu | B28D 1/225 125/23.02 |
| 6,457,469 | B1 * | 10/2002 | Mueller | B28D 1/225 125/23.01 |
| 8,578,923 | B2 * | 11/2013 | Ghelfi | B28D 1/225 125/23.01 |
| 2009/0044681 | A1 * | 2/2009 | Torrents I Comas | B28D 1/225 83/886 |
| 2014/0238376 | A1 * | 8/2014 | Courtemanche | B28D 1/225 125/23.01 |
| 2014/0246470 | A1 * | 9/2014 | Baro Cabrero | B28D 1/225 225/96.5 |
| 2015/0224672 | A1 * | 8/2015 | Baro Cabrero | B28D 1/225 125/23.01 |
| 2017/0266844 | A1 * | 9/2017 | Sarmiento | B28D 1/223 |
| 2018/0093393 | A1 * | 4/2018 | Soler Balcells | B28D 1/225 |

FOREIGN PATENT DOCUMENTS

| | | |
|---|---|---|
| ES | 1 018 011 U | 1/1992 |
| ES | 2 101 611 A1 | 7/1997 |
| ES | 1 042 563 U | 9/1999 |
| WO | WO 95/08424 A1 | 3/1995 |

OTHER PUBLICATIONS

Written Opinion, in Spanish, of related International Patent Application No. PCT/ES2016/070543 dated Nov. 11, 2016.

* cited by examiner

CUTTING AND SEPARATING DEVICE APPLICABLE TO MANUAL CERAMIC CUTTERS

CROSS-REFERENCE TO RELATED APPLICATIONS

This application is a National Stage entry of International Application No. PCT/E52016/070543, filed Jul. 19, 2016, which claims priority to Spanish Patent Application No, 2015-31375, filed Sep. 28, 2015, The disclosures of the priority applications are incorporated in their entirety herein by reference.

OBJECT OF THE INVENTION

The object of the present invention relates to a cutting and separating device applicable to manual ceramic cutters, said cutting device comprising a carriage that can move longitudinally with respect to the cutter and provided with a transverse shaft on which a collapsible handle comprising the cutting element is mounted.

This device comprises a mechanism to actuate the separator for separating the ceramic part marked by the cutting tool, both the cutting tool and the separator being actuated by a single handle.

FIELD OF APPLICATION OF THE INVENTION

This invention is applicable in the field of manufacturing manual ceramic cutters, and specifically to cutting and separating devices for ceramic parts applicable to said manual cutters.

STATE OF THE ART

Manual ceramic cutters that have a base on which guides for longitudinal movement and a cutting tool are mounted for marking a cutting line on the ceramic parts placed on the base of the cutter are currently known.

These cutters also have a separator that, when actuated, acts on the previously marked ceramic part, causing the breaking of the same along the cutting line.

With regard to these manual ceramic cutters, it is necessary to differentiate those in which the separator is independent from the cutting tool from those in which the separator and the cutting tool are included in the same head, such that once the cut or marking of the ceramic part has been made with the cutting tool, the integrated separator must be actuated to separate the ceramic part into two parts.

The cutters of this second group, which have a device with a cutting tool and a separator on a same carriage or head, are the ones that have a stronger relationship with the device of the present invention. A few noteworthy examples may be found in the following documents:

In document ES 0295592 U, the separator and the cutting tool are mounted directly on a front end of the actuation handle and distanced along the same; making it necessary to move the cutting tool outside of the support area for the ceramic part in order to be able to actuate the separator. This prior art also has the drawback in that the direct actuation of the separator by means of the handle requires the application of substantial force to achieve the separation of the previously marked ceramic part.

Document ES 2101611 of the same holder as the present invention describes a cutting and separating machine for flat ceramic parts and similar, wherein the cutting tool is mounted directly on the handle and the separator is actuated by the handle by means of a set of levers that must be manually arranged in a specific position when the separator is actuated by rotating the handle.

This actuation mechanism has the drawback in that, in addition to actuating the handle, the user has to manipulate the set of levers to arrange the separator in an operative or inoperative position.

Document ES 1042563 U of the same holder as the present invention describes a cutting and separating machine for flat ceramic parts, wherein the cutting tool is fixed to the handle and the separator is collapsible and actuated by means of the movement along the handle of the positioning mechanism connected to the separator by means of a connecting rod.

In this case, the operator must use both of their hands to grip the handle and for actuating the positioning mechanism of the separator for separating ceramic parts.

Document ES 1018011 U, also of the same holder of the present invention, describes a machine for cutting ceramic parts with a linear guide on bearings in which the separator of the parts is actuated by the handle by means of a connecting rod, while the cutting tool must be manually positioned in an operative position or an inoperative position by tilting a support part of said tool.

In this case, just like in the previous cases, it is also necessary to secure the handle and manipulate the cutting tool to arrange it in a position of use or in an inoperative position.

One additional drawback of these cutting and separating devices for ceramic parts is that in a position of use the separator is kept in a specific relative position with respect to the handle, not envisaging an adjustment that would allow for different relative positions based on the thickness of the ceramic part to be separated.

DESCRIPTION OF THE INVENTION

The cutting and separating device applicable to manual ceramic cutters, object of the present invention, has some particular constructive features aimed at allowing the actuation of the cutting tool and the separator merely by means of the actuation of the handle, and by using just one hand, which significantly simplifies the actuation thereof with respect to the aforementioned prior art.

Another objective of the invention is to allow for different relative positions between the handle and the separator when the same is in an operative position, and choosing a relative position based on the thickness of the ceramic part to be separated.

To this end, and in accordance with the invention, this cutting and separating device comprises: a toothed part comprising a separator for separating ceramic parts, mounted on the transverse shaft of the handle with the possibility of rotation between an operative position, wherein the separator goes beyond the cutting plane of the tool, and an inoperative position wherein said separator does not reach the cutting plane of the tool; a spring which acts on the toothed part and for holding the toothed part in an inoperative position; a toothed actuator mounted on the handle, a spring which acts on said actuator for maintaining it in an engaged position with the toothed part and a manual trigger element for disengaging the toothed actuator with respect to the toothed part; said elements arranged such that: when rotating the handle in a descending direction, the actuator rotates the toothed part until it reaches an operative position of the separator, and by actuating the trigger element, the actuator releases the toothed part, returning said toothed part by the action of the spring associated with the same to the inoperative position.

With these characteristics, the cutting and separating device can be actuated in a simple and easy manner by the operator by using just one hand, only having to play with different rotations of the handle in an ascending and descending direction.

To allow for the choice of different relative positions between the handle and the separator when the same is operative, it has been envisaged that the toothed part and/or the toothed actuator has a toothed section with several teeth to mutually engage in different relative positions, such that in actuating the separator by rotating the handle towards the lower area, said separator protrudes to a greater or lesser degree from the plane of the cutting tool as a function of the thickness of the ceramic part to be separated.

These characteristics and other characteristics of the invention will be more easily understood in light of the exemplary embodiment shown in the figures attached.

DESCRIPTION OF THE FIGURES

As a complement to the description being made, and for the purpose of helping to make the characteristics of the invention more readily understandable, this specification is accompanied by a set of drawings which, by way of illustration and not limitation, represent the following.

PREFERRED EMBODIMENT OF THE INVENTION

Figure 1:
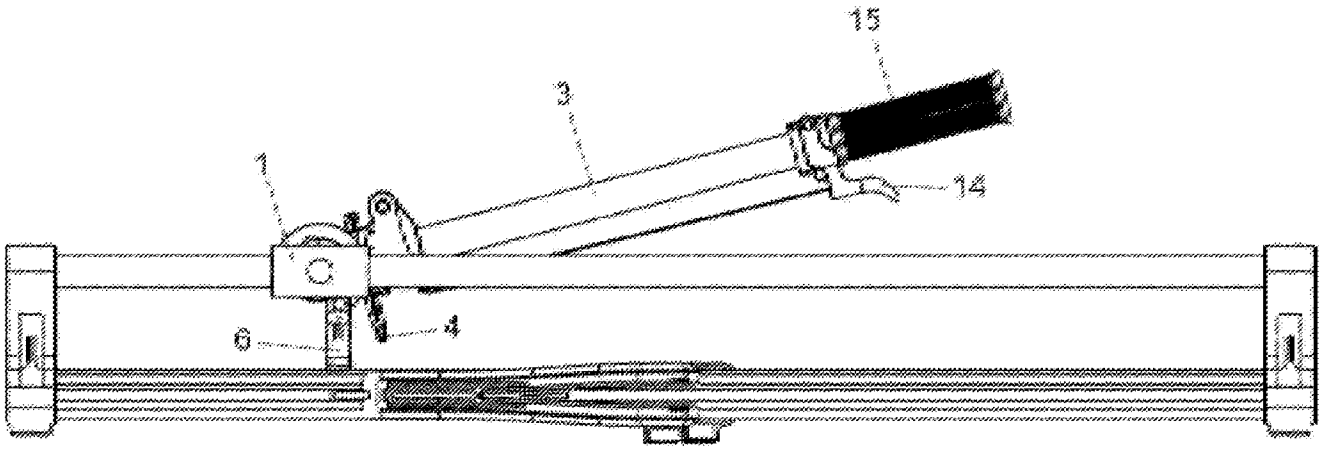
FIGS. 1 and 2 show a elevation view and a perspective view of an exemplary embodiment of the cutting and separating device for ceramic parts mounted on a manual cutter for ceramic parts.
Figure 2:
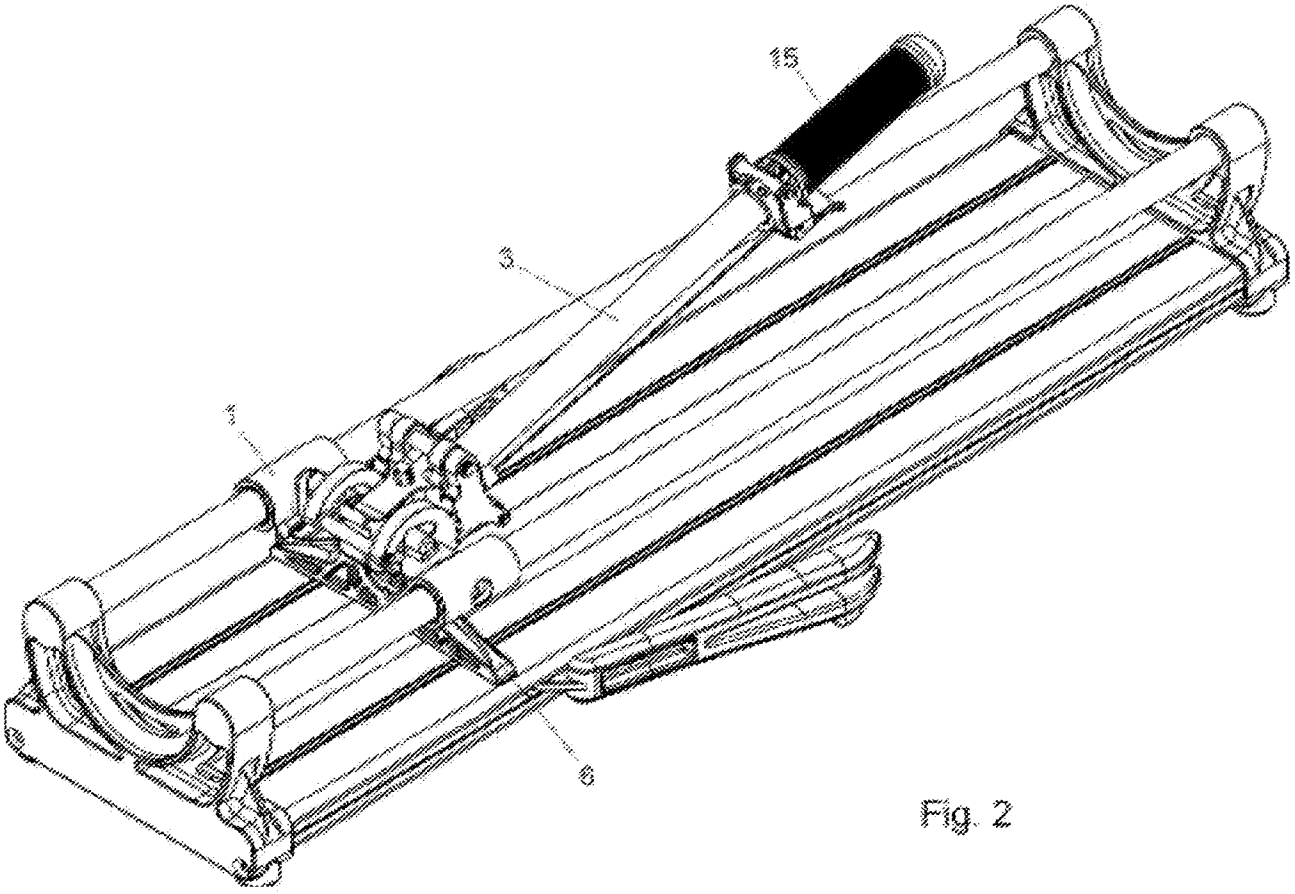

As can be seen in FIGS. 1 and 2, this cutting and separating device comprises a carriage (1) which can move longitudinally on guides of a manual ceramic cutter arranged on top of a base or support surface for the ceramic parts to be cut.

This carriage (1) has a transverse shaft (2) on which a handle (3) comprising a cutting tool (4) and a toothed part (5) comprising a separator for the ceramic parts are mounted with the possibility of rotation.

Figure 3:
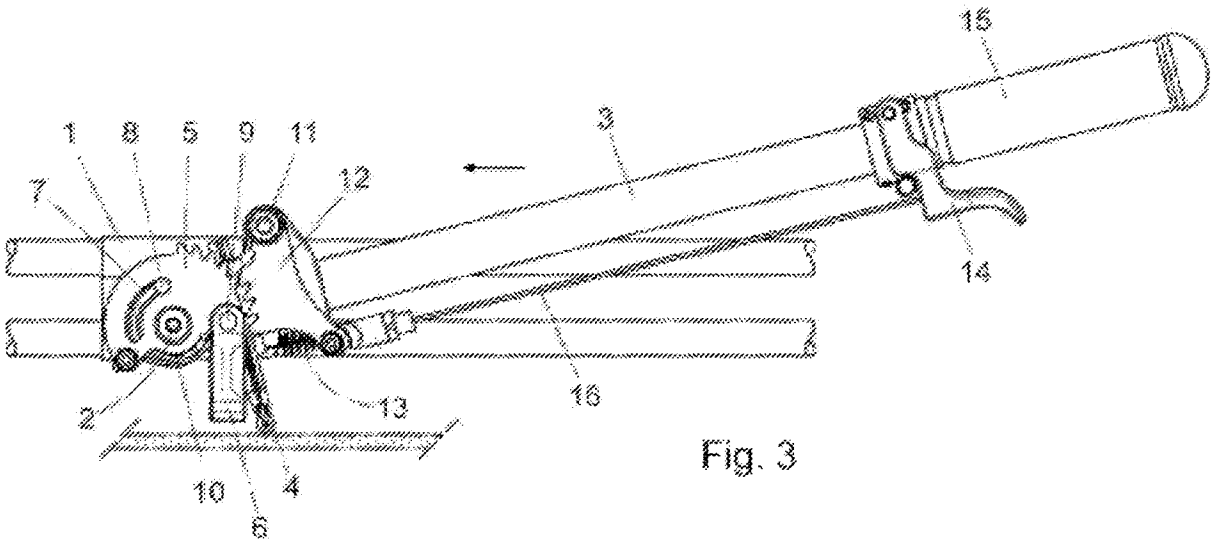
FIGS. 3, 4, 5 and 6 each show elevation views of the cutting and separating device; in an operative cutting position; in an engaged position of the actuator with the toothed part; in an actuation position of the separator; and in a position of releasing the toothed part comprising the separator by the toothed actuator, respectively.
Figure 4:
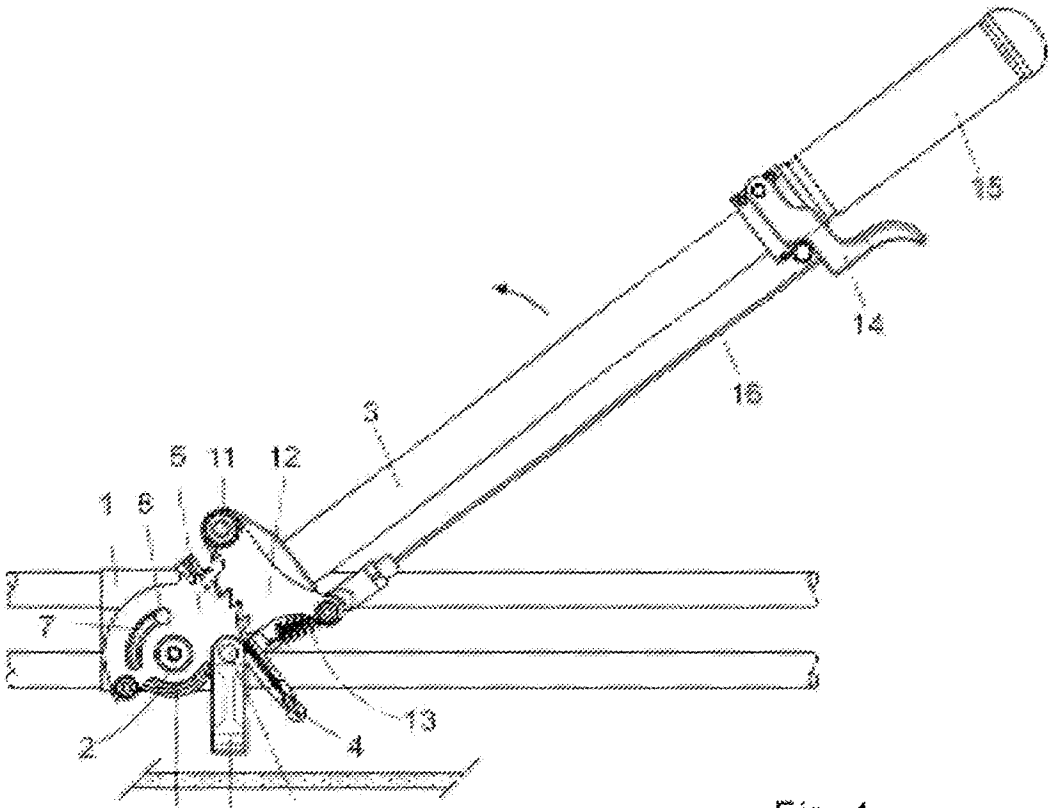
Figure 5:
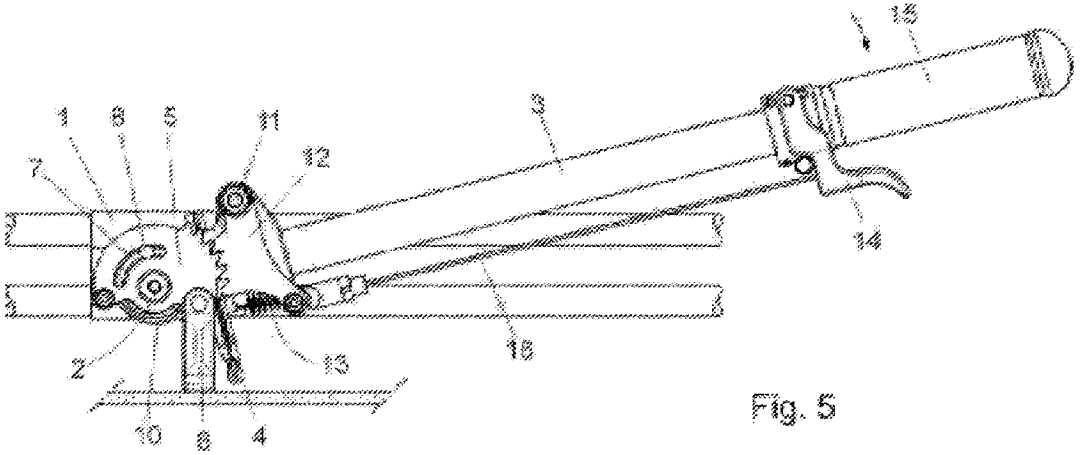
Figure 6:
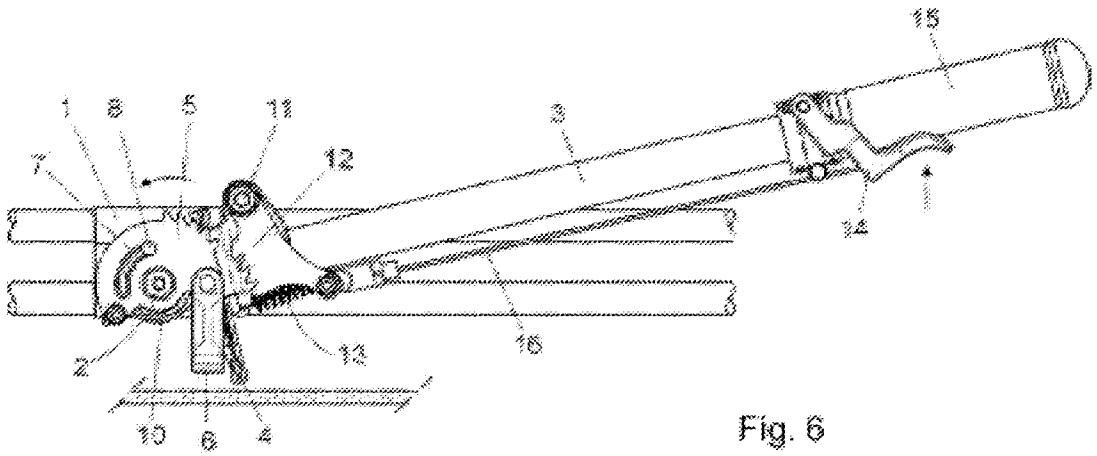

The toothed part (5) has curved eyelets (7) which house lugs (8) defined on the carriage (1) and which limit the rotation of the toothed part (5) between an inoperative position represented in FIGS. 3, 4 and 6 and an operative position represented in FIG. 5.

The separator (6) is suspended from the toothed part (5) with the possibility of free rotation by means of a second transverse shaft (9) parallel to the transverse shaft (2) of the rotation of the handle (3) and the toothed part (5).

Acting on the aforementioned toothed part (5) is a spring (10) for holding it in an inoperative position.

On the front end of the handle a toothed actuator is mounted by means of a rotational shaft (11) on which a spring (13) acts to hold it in an engaged position with the toothed part (5).

In the example shown, both the toothed part (5) and the toothed actuator (12) have opposing toothed sections for the engagement thereof with a greater or smaller number or teeth based on the thickness of the ceramic part to be separated.

The aforementioned toothed actuator (12) is connected to a manual trigger element that allows it to be disengaged from the toothed part (5) and which is made up of an actuation trigger (14) near the grip (15) of the handle and connected to said toothed actuator (12) by means of a cable or rod (16). The proximity of the actuation trigger (4) to the grip allows for the actuation thereof with a finger of the same hand used for holding the handle, which significantly simplifies the use of the cutting and separating device for ceramic parts.

With these characteristics, when the toothed actuator is disengaged from the toothed part (5), the spring (10) arranges the toothed part (5) in an inoperative position, represented in FIG. 3 and in which the separator (6) does not reach the cutting plane of the cutting tool (4).

As shown in FIG. 4, when the handle is rotated towards the upper area, going beyond a predetermined angle, the teeth of the toothed actuator (12) engage with the teeth of the toothed part (5) and by subsequently rotating the handle (3) in a descending manner, as shown in FIG. 5, the toothed actuator (12) causes the rotation of the toothed part (5) until reaching an operative apposition in which the separator goes beyond the cutting plane of the tool, allowing the separation of the previously marked ceramic part.

After performing the separation of the ceramic part, it is enough to just press the trigger (14) for the toothed actuator (12) to release the toothed part (5) and the same returns by the action of the spring (10) to the inoperative position, the device remaining in the cutting position.

Having sufficiently described the nature of the invention, in addition to an example of preferred embodiment, it is hereby stated for the relevant purposes that the materials, shape, size and layout of the described elements may be modified, provided that it does not imply altering the essential characteristics of the invention claimed below.

The invention claimed is:

1. A cutting and separating device applicable to manual ceramic cutters; said cutting and separating device comprising a carriage that can move longitudinally with respect to the cutter and provided with a transverse shaft on which a collapsible handle is mounted comprising a cutting tool the cutting and separating device comprising: a toothed part comprising a separator for separating ceramic parts, mounted on the transverse shaft of the handle with the possibility of rotating between: an operative position in which the separator goes beyond the cutting plane of the tool and an inoperative position in which said separator does not reach the cutting plane of the tool; a spring which acts on the toothed part for holding the toothed part in an inoperative position; a toothed actuator mounted on the handle, a spring which acts on said toothed actuator for maintaining the tooth actuator in an engaged position with the toothed part and one or more trigger elements for disengaging the toothed actuator with respect to the toothed part; said one or more manual trigger elements arranged such that: rotating the handle in an ascending direction, above a predetermined angle, causes the toothed actuator to automatically engage in the toothed part; rotating the handle in a descending direction causes the toothed actuator to rotate the toothed part until reaching an operative position of the separator; and the actuation of one of the one or mare manual trigger elements causes the release by the toothed actuator of the toothed part which automatically returns to the inoperative position.

2. The device, according to claim 1, wherein the toothed part or the toothed actuator have a toothed section with successive teeth for the mutual engagement thereof in different relative positions.

3. The cutting and separating device, according to claim 1, wherein the carriage has lugs housed in curved eyelets of the toothed part and which form stop means of the toothed part between the operative and inoperative positions.

4. The device, according to claim 1 wherein the separator is suspended from the toothed part with the possibility of free rotation, by means of a second transverse shaft parallel to the transverse shaft of the rotation of the handle and the toothed part.

5. The device, according to claim 1, wherein the trigger element of the toothed actuator comprises an actuation trigger near a grip for gripping the handle and a cable or rod for connecting the trigger to said toothed actuator.

* * * * *